US007387861B2

(12) United States Patent
Black

(10) Patent No.: US 7,387,861 B2
(45) Date of Patent: Jun. 17, 2008

(54) ADDITIVE FOR PHOTOCONDUCTOR END SEAL WEAR MITIGATION

(75) Inventor: David Glenn Black, Longmont, CO (US)

(73) Assignee: Lexmark International, Inc., Lexington, KY (US)

( * ) Notice: Subject to any disclaimer, the term of this patent is extended or adjusted under 35 U.S.C. 154(b) by 247 days.

(21) Appl. No.: 11/311,602

(22) Filed: Dec. 19, 2005

(65) Prior Publication Data

US 2007/0141492 A1 Jun. 21, 2007

(51) Int. Cl.
*G03G 5/047* (2006.01)

(52) U.S. Cl. ..... 430/58.05; 399/102

(58) Field of Classification Search ..... 430/66, 430/58.05; 399/102

See application file for complete search history.

(56) References Cited

U.S. PATENT DOCUMENTS 4,766,048 A 8/1988 Hisamura
4,937,163 A * 6/1990 Tam et al. ..... 430/41
5,399,452 A 3/1995 Takegawa et al.
5,789,506 A * 8/1998 Toribuchi et al. ..... 526/214
5,994,014 A 11/1999 Hinch et al.
6,071,660 A 6/2000 Black et al.
6,553,195 B2 4/2003 Korfhage et al.

* cited by examiner

*Primary Examiner*—Christopher RoDee
(74) *Attorney, Agent, or Firm*—Steven J. Grossman

(57) ABSTRACT

This invention provides an organic photoconductor which does not experience end-seal wear in normal use. This invention provides charge transport formulation that is easily prepared and coated by standard, dip-coating methods. This is realized by addition of a small amount of poly (methyl methacrylate-co-ethylene glycol dimethacrylate). Commercially available, 8μ spherical particles are used. These microspheres are insoluble in common organic solvents, but are readily dispersed into polycarbonate-based charge transport formulations. A photoconductor roller is mounted in pressure engagement with two end seals, each on opposite side of the roller.

12 Claims, No Drawings

ADDITIVE FOR PHOTOCONDUCTOR END SEAL WEAR MITIGATION

TECHNICAL FIELD

This invention relates to the use of a laminate-type organic photoconductor in electrophotographic printing. More particularly, the invention describes a photoconductor with greatly improved end-seal wear.

BACKGROUND OF THE INVENTION

Personal and network laser printers have become ubiquitous in both home and office environments. An important driver for these placements is the lower cost of the printers. Replaceable cartridges supply laser-printer toner, as well as other components of the electrophotographic process. More robust cartridge components are desired to meet requirements for print speed and cartridge life. A critical component to the electrophotographic process, and thus of the typical printer cartridge, is the organic photoconductor (OPC).

An electrophotographic photoreceptor of the dual-layer, laminate-type is composed of a conductive substrate, a thin charge generation layer (CGL) coated over the substrate, and a much thicker charge transport layer coated over the CGL. Such photoconductors generally are charged negatively. The following discussion relates to this type of photoconductor. In this arrangement, an electrically conductive substrate possessing an appropriate work function is required to accept electrons from the charge generation layer under the influence of an electric field.

In this discussion, the preferred electrically conductive substrate is anodized aluminum. In a preferred embodiment, the substrate is an anodized aluminum cylindrical tube. The charge generation layer is typically less than 1μ in thickness. The purpose of this layer is to generate charge carriers upon absorption of light. The photoactive species in this layer is typically an organic-based pigment with a broad optical absorption spectrum. It is necessary to match the absorption maximum with the wavelength output of the laser in order to generate the pigment excited state via photon absorption. Generation of this excited state is the first step in the photoconductive process.

In a preferred embodiment, the pigment/laser combination is a pigment with an absorption max in the near infrared, and a laser output in this region. In a more preferred embodiment, the combination includes a pigment with absorption max greater than 750 nm, and a semiconductor laser with output wavelength in this region. In a still more preferred embodiment, the pigment is a phthalocyanine with absorption max around 780 nm, and a gallium/aluminum/arsenide (Ga/Al/As) laser tuned to a wavelength output of 780 nm.

The charge transport layer is much thicker than the charge generation layer, typically 15-30μ. The charge transport layer has two functions: (1) to accept the photogenerated charge carriers from the charge generation layer; (2) migrate these carriers through the charge transport layer to discharge the photoconductor surface. The electronically active species in this layer is typically a nitrogen-containing small molecule doped into an inert polymeric matrix. In a preferred embodiment, the charge transport molecule is either a hydrazone or an arylamine, and the polymer is a polycarbonate. In a more preferred embodiment, the charge transport molecule is the triarylamine N,N'-diphenyl-N,N'-di(m-tolyl)-p-benzidene-N,N'-diphenyl-N,N'-bis(3-methylphenyl)-(1,1'-biphenyl)-4,4'-diamine (TPD).

The photoconductor of the type described in the foregoing is an integral part of the electrophotographic process that forms the basis of the laser printer industry. The electrophotographic process comprises the following steps: (1) charging a photoconductive imaging member; (2) latent image formation via selective exposure to monocharomatic light; (3) develop the latent image with toner; (4) transfer the toned image to paper; (5) fuse the toner to paper. Although other steps (e.g. removing untransferred toner from the photoconductor with a cleaner blade) may be included, the five steps described above are central to the technology.

A current, state-of-the-art laser printer cartridge incorporates minor components that allow for printing tens-of-thousands of pages. The present invention addresses an issue arising from the cleaner end-seals. These seals ride on both the top and bottom of the photoconductor surface and are responsible for ensuring that untransferred toner does not escape into the cartridge. The end-seals abrade the photoconductor coating, resulting in a narrow band (1-6 mm) of exposed aluminum about 10 mm from the top and bottom of the photoconductor This abraded region is outside of the print area. However, when printing in hot or wet environments, the exposed aluminum accepts current from the charge roller. This lowers the charge roll voltage, which produces lower photoconductor charging, resulting in an area of background on the printed page. There remains an unfulfilled need to eliminate end-seal wear on the photoconductor that is (1) easily manufactured, (2) low cost.

The present invention is to the use of a spherical organic particle as an additive to the charge transport layer of an organic photoconductor. Addition of organic particles has been described in the organic photoconductor patent literature. See, for example, U.S. Pat. No. 6,071,660 to Black, et al., and references therein. The use of spherical organic and silicon-based additives has been described in U.S. Pat. No. 4,766,048 to Hisamura.

DISCLOSURE OF THE INVENTION

This invention provides an organic photoconductor which does not experience end-seal wear in normal use. This invention provides charge transport formulation that is easily prepared and coated by standard, dip-coating methods. The advantages of the invention are realized by addition of a small amount of a specific charge transport additive, poly(methyl methacrylate-co-ethylene glycol dimethacrylate) as particles of about 8 micron size. Such a material is commercially-available as 8μ spherical particles. These microspheres are insoluble in common organic solvents, but are readily dispersed into polycarbonate-based charge transport formulations. The resulting dispersions are resistant to particulate settling and provide a homogenous distribution of particles without the need for agitation.

DESCRIPTION OF THE PREFERRED EMBODIMENTS

This invention is applicable to end seals in general brought in friction contact with photoconductor roller or other photoconductors subject to friction. A representative end seal is described with of FIGS. 1-5 of U.S. Pat. No. 6,553,195 B2 to Korfhage et al. That seal is on one side of a photoconductor roller and a second seal is on the opposite side of the photoconductor roller. A cleaning blade extends between the two seals. The seals are on opposite sides of the drum and are made of are of resin or other somewhat pliable material. The seals are mounted in pressure contact with the roller during operation of the drum to block toner on the drum from movement past the seal. The seal of the foregoing Korfhage patent has a portion with ribs at an angle which direct toner toward the center of the drum, although such refinements are not significant with respect to this invention, which applies generally to end seals.

The present invention differs fundamentally from the foregoing Hisamura patent in the material of the particle employed. Additionally in Hisamura the largest particle size disclosed is 6μ. The particle size of the present invention is about 8μ. Similarly, Hisamura teaches away from particle sizes as large as 8μ in column 8, lines 38-46 which state that particle of size greater than 4μ, and particularly greater than 6μ, will diminish the properties of the photosensitive layer.

A small degradation of the initial electrostatics is indeed observed in the present invention. However, the elimination of end-seal wear is an overriding advantage. Those skilled in the art understand the inverse relationship between particle size and dispersion stability, i.e., larger particle sizes lead to lower dispersion stability. The use of 8μ particles would therefore be more prone to settling than smaller particles. Column 7, lines 31-34 of the foregoing Black et al patent describes the use of styrene-divinylbenzene co-polymers. Addition of 8μ spherical particles of poly(styrene-co-divinylbenzene) failed to mitigate end-seal wear. A surprising result is the finding that addition of low concentrations of 8μ spherical particles of poly(methyl methacrylate-co-ethylene glycol dimethacrylate) eliminates end-seal wear.

This invention provides an organic photoconductor which does not experience end-seal wear in normal use. This invention provides charge transport formulation that is easily prepared and coated by standard, dip-coating methods. A stable charge transport formulation is required to ensure a homogeneous distribution of materials within a coated photoconductor, and throughout a manufacturing run. The advantages of the invention are realized by addition of a small amount of a specific charge transport additive, poly (methyl methacrylate-co-ethylene glycol dimethacrylate), preferably in amount of about 3 percent by weight of the outer layer. This material is commercially available as 8μ spherical particles. These microspheres are insoluble in common organic solvents, but are readily dispersed into polycarbonate-based charge transport formulations. The resulting dispersions are resistant to particulate settling and provide a homogenous distribution of particles without the need for agitation.

EXAMPLE 1

Charge Generation Layer

Preparation of the titanylphthalocyanine dispersion for the charge generation layer is described in U.S. Pat. No. 5,994,014 to Hinch et al. The dispersion is coated over cylindrical anodized substrates to about 0.5μ via dip coating. The thickness of the layer is conveniently tracked by recording the optical density using a Macbeth TR524 densitometer.

EXAMPLE 2

Electrostatics

Table 1 summarizes the charge transport formulation and material weights (in grams) for Example 2.

TABLE 1

| Material | Control | 1% Additive | 2% Additive | 3% Additive |
|---|---|---|---|---|
| THF | 286 | 286 | 286 | 286 |
| 1,4-dioxane | 82 | 82 | 82 | 82 |
| TPD | 40 | 40 | 40 | 40 |
| PCA | 60 | 59 | 58 | 57 |
| DC-56 | 6 drops | 6 drops | 6 drops | 6 drops |
| Additive | 0 | 1 | 2 | 3 |

Materials in Table 1 and other Tables are:

TPD: N,N'-diphenyl-N,N'-di(m-tolyl)-p-benzidene-N,N'-diphenyl-N,N'-bis(3-methylphenyl)-(1,1'-biphenyl)-4,4'-diamine, commercially from Sentient Imaging Technologies GmbH.

PCA: Polycarbonate A, commercially available Bayer Chemical Co. as Makrolon 5208.

DC-56: (ethylmethyl, methyl(2-phenylpropyl) siloxane, commercially available from Dow Corning Corp.

Additive: poly(methyl methacrylate-co-ethylene glycol dimethacrylate), commercially available from Aldrich Chemical Co.

Poly(methyl methacrylate-co-ethylene glycol dimethacrylate), commercially available from Aldrich Chemical Co., is added to a vigorously stirring solution of THF/dioxane. The surfactant DC-56 is added followed by PCA and TPD. The control was prepared in the absence of poly(methyl methacrylate-co-ethylene glycol dimethacrylate). The resulting charge transport formulations were coated over the charge generation layer described in Example 1 via dip coating. Controlling the coat speed changes the coating thickness. A voltage versus exposure energy experiment was preformed on an in-house tester with an expose-to-develop time of 49 ms. and a thickness of about 28μ. A set of initial electrostatic measurements was recorded and the photoconductor was exposed to 1000 charge/discharge cycles in order to examine the electrical fatigue. The results are summarized in Tables 2 and 3.

TABLE 2

Initial Electrostatic Properties for Example 2

| Drum Description | V@0.00 | V@0.10 | V@0.19 | V@0.29 | V@0.45 | V@0.70 | DD@1 s |
|---|---|---|---|---|---|---|---|
| 1% Additive | −849 | −300 | −143 | −114 | −102 | −94 | 18 |
| 2% Additive | −851 | −292 | −142 | −110 | −99 | −94 | 20 |
| 4% Additive | −854 | −292 | −148 | −121 | −108 | −101 | 20 |
| Control | −850 | −305 | −126 | −88 | −77 | −72 | 17 |

TABLE 3

Electrostatic Properties after 1k Fatigue for Example 2.

| Drum Description | V@0.00 | V@0.10 | V@0.19 | V@0.29 | V@0.45 | V@0.70 | DD@1 s |
|---|---|---|---|---|---|---|---|
| 1% Additive | −850 | −299 | −158 | −131 | −118 | −110 | 36 |
| 2% Additive | −851 | −297 | −165 | −138 | −126 | −121 | 35 |
| 4% Additive | −855 | −307 | −183 | −159 | −147 | −139 | 33 |
| Control | −849 | −293 | −124 | −92 | −80 | −75 | 36 |

Tables 2 and 3 quantify the loss of photoconductor sensitivity and increased electrical fatigue imparted by the poly(methyl methacrylate-co-ethylene glycol dimethacrylate).

EXAMPLE 3

End-Seal Wear

Organic photoconductors containing 3% poly(methyl methacrylate-co-ethylene glycol dimethacrylate) were prepared as described in Examples 1 and 2. Photoconductors were also prepared without additive for use as controls. Two drums of each set were run to 40 k prints in Lexmark OPTRA T 620 printers. A summary of the end-seal wear performance is shown in the following table. End seal wear is that experience by a photoconductor roller having an end seals on opposite sides.

TABLE 4

End-Seal Wear Comparison

| OPC | # of Drums | End-Seal Wear (Onset) | Width of End-Seal Wear (mm), Top | Width of End-Seal Wear (mm), Bottom |
|---|---|---|---|---|
| Control | 2 | ca. 15k | 4 mm | 5 mm |
| 3% Additive | 2 | NA | 0 | 0 |

The table above shows the absence of end-seal wear, even after 40 k prints, for OPC drums containing 3% poly(methyl methacrylate-co-ethylene glycol dimethacrylate).

EXAMPLE 4

Charge transport formulations containing 0 (control) and 3% poly(methyl methacrylate-co-ethylene glycol dimethacrylate) were prepared as described in Table 1. The resulting charge transport formulations were coated over the charge generation layer described in Example 1 via dip coating. The formulations were then allowed to stand at room temperature for 4 h. A second set of charge transport coatings was done as described above. Note that there was no visible change in the appearance of either formulation. A voltage versus exposure energy experiment was preformed on an in-house tester with an expose-to-develop time of 49 ms. and a thickness of about 25μ The results are summarized in Table 5. The results are summarized in Table 5.

TABLE 5

Initial Electrostatic Properties for Example 2

| Drum Description | V@0.00 uJ | V@0.12 uJ | V@0.70 uJ | dV@1 s |
|---|---|---|---|---|
| 3% Additive, T = 0 h | −857.3 | −294.5 | −71.6 | 22.2 |
| 3% Additive, T = 4 h | −856.4 | −306.6 | −72.1 | 23.6 |
| Control, T = 0 | −857.0 | −230.8 | −55.4 | 20.9 |
| Control, T = 4 h | −852.5 | −211.5 | −63.2 | 24.9 |

The small change in electrical properties demonstrates the stability of formulations incorporating low concentrations of poly(methyl methacrylate-co-ethylene glycol dimethacrylate)

Details of the foregoing are not limiting so long as the additive is a poly(methyl methacrylate-co-ethylene glycol dimethacrylate) of particulate size of about 8 micron. An amount of this particular of about 3 percent by weight of the outer layer of the photoconductor roller is preferred.

What is claimed is:

1. A photoconductor having a conductive substrate, a charge generation layer and an outer charge transport layer, said outer layer comprising particulate poly(methyl methacrylate-co-ethylene glycol dimethacrylate) present in the amount of 1 to 3 percent by weight of the weight of said outer layer and a charge transport additive.

2. The photoconductor of claim 1 in which said particulate size is about 8 microns.

3. The photoconductor of claim 2 in which said particulate poly(methyl methacrylate-co-ethylene glycol dimethacrylate) is spherical.

4. The photoconductor of claim 1 in which said poly (methyl methacrylate-co-ethylene glycol dimethacrylate) is in amount of about 3 percent by weight of the weight of said outer layer.

5. The photoconductor of claim 4 in which said particulate size is about 8 microns.

6. The photoconductor of claim 5 in which said particulate poly(methyl methacrylate-co-ethylene glycol dimethacrylate) is spherical.

7. A photoconductor roller having a conductive substrate, a charge generation layer and an outer charge transport layer, said outer layer comprising particulate poly(methyl methacrylate-co-ethylene glycol dimethacrylate) present in the amount of 1 to 3 percent by weight of the weight of said outer layer, and a charge transport additive and two toner end seals each contacting said roller on opposite ends of said roller.

8. The photoconductor roller of claim 7 in which said particulate size is about 8 microns.

9. The photoconductor roller of claim 8 in which said particulate poly(methyl methacrylate-co-ethylene glycol dimethacrylate) is spherical.

10. The photoconductor roller of claim 7 in which said poly(methyl methacrylate-co-ethylene glycol dimethacrylate) is in amount of about 3 percent by weight of the weight of said outer layer.

11. The photoconductor roller of claim 10 in which said particulate size is about 8 microns.

12. The photoconductor roller of claim 11 in which said particulate poly(methyl methacrylate-co-ethylene glycol dimethacrylate) is spherical.

* * * * *